US009841719B2

(12) United States Patent
Nakachi

(10) Patent No.: US 9,841,719 B2
(45) Date of Patent: Dec. 12, 2017

(54) IMAGE FORMING APPARATUS

(71) Applicant: KYOCERA Document Solutions Inc., Osaka (JP)

(72) Inventor: Kazuhiro Nakachi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/362,960

(22) Filed: Nov. 29, 2016

(65) Prior Publication Data

US 2017/0153595 A1 Jun. 1, 2017

(30) Foreign Application Priority Data

Nov. 30, 2015 (JP) ..... 2015-233380

(51) Int. Cl.
*G03G 21/00* (2006.01)
*G03G 21/10* (2006.01)
*G03G 21/20* (2006.01)

(52) U.S. Cl.
CPC ..... *G03G 21/10* (2013.01); *G03G 21/203* (2013.01)

(58) Field of Classification Search
CPC ..... G03G 21/20; G03G 21/206; G03G 21/10; G03G 21/203
See application file for complete search history.

(56) References Cited

U.S. PATENT DOCUMENTS 6,112,046 A * 8/2000 Suzuki ..... G03G 21/105 399/359
2004/0052545 A1* 3/2004 Satoh ..... G03G 21/203 399/92
2006/0216055 A1* 9/2006 Katoh ..... G03G 15/2003 399/93
2007/0059025 A1* 3/2007 Lee ..... G03G 15/0898 399/98
2007/0146827 A1* 6/2007 Kakita ..... G03G 21/206 358/498
2009/0136257 A1* 5/2009 Hattori ..... G03G 21/206 399/111
2009/0220252 A1* 9/2009 Onishi ..... G03G 15/0898 399/27
2014/0147160 A1* 5/2014 Konishi ..... G03G 21/206 399/92
2014/0294475 A1* 10/2014 Nishikawa ..... G03G 21/105 399/358
2015/0268627 A1* 9/2015 Yokota ..... G03G 21/206 399/92

(Continued)

FOREIGN PATENT DOCUMENTS

JP 2002-278268 A 9/2002

*Primary Examiner* — Clayton E LaBalle
*Assistant Examiner* — Ruifeng Pu
(74) *Attorney, Agent, or Firm* — Stein IP, LLC

(57) ABSTRACT

An image forming apparatus is provided with a printing portion, a waste toner collection portion that includes a conveyance member that is driven by a motor, and conveys waste toner, thereby to collect the waste toner in a waste toner container, a current detection portion for detecting a motor current value, a fan that discharges scattering toner, and a control portion. In driving the fan, the control portion detects a value of the motor current value and sets rotation speed of the fan so that the larger said detected value of the motor current value, the higher the rotation speed.

5 Claims, 6 Drawing Sheets

(56) References Cited

U.S. PATENT DOCUMENTS

| | | | | |
|---|---|---|---|---|
| 2015/0346684 | A1* | 12/2015 | Sasaki | G03G 21/203 399/44 |
| 2016/0004217 | A1* | 1/2016 | Orikasa | G03G 21/206 399/92 |
| 2016/0026119 | A1* | 1/2016 | Ohashi | G03G 21/12 399/358 |
| 2016/0342137 | A1* | 11/2016 | Goda | G03G 21/206 |
| 2017/0171416 | A1* | 6/2017 | Yamada | G03G 21/20 |

* cited by examiner

202(200)

| SCATTERING LEVEL | GRADIENT |
|---|---|
| HIGHEST LEVEL | 1 |
| INTERMEDIATE LEVEL | 0.5 |
| LOWEST LEVEL | 0 |

MOTOR CURRENT VALUE
HIGHEST LEVEL (GRADIENT: LARGEST)

MOTOR CURRENT VALUE
INTERMEDIATE LEVEL
(GRADIENT: INTERMEDIATE)

MOTOR CURRENT VALUE
LOWEST LEVEL (GRADIENT: SMALLEST)

IMAGE FORMING APPARATUS

INCORPORATION BY REFERENCE

This application is based upon and claims the benefit of priority from the corresponding Japanese Patent Application No. 2015-233380 filed on Nov. 30, 2015, the entire contents of which are incorporated herein by reference.

BACKGROUND

The present disclosure relates to an image forming apparatus that forms a toner image and prints the toner image on a paper sheet.

Conventionally, there is known an image forming apparatus that develops, by using a developing device, an electrostatic latent image into a toner image and transfers (prints) the toner image on a paper sheet. In such an image forming apparatus, for example, in order to suppress contamination inside the apparatus with scattering toner that scatters inside the apparatus, a fan that collects the scattering toner is provided.

SUMMARY

An image forming apparatus according to one aspect of the present disclosure is provided with a printing portion, a waste toner collection portion, a current detection portion, a fan, and a control portion. The printing portion forms a toner image and prints the toner image on a paper sheet. The waste toner collection portion includes a motor and a conveyance member that is driven by the motor, and conveys, by using the conveyance member, waste toner generated at the time of formation of the toner image by the printing portion, thereby to collect the waste toner in a waste toner container. The current detection portion is to detect a motor current value that is a value of an electric current flowing through the motor. The fan sucks in scattering toner that scatters inside the image forming apparatus and discharges the scattering toner to outside the apparatus. The control portion controls driving of the fan. Further, in driving the fan, based on an output of the current detection portion, the control portion detects a value of the motor current value, and sets rotation speed of the fan so that the larger said detected value of the motor current value, the higher the rotation speed of the fan.

DETAILED DESCRIPTION

<Outline of Image Forming Apparatus>

Figure 1:
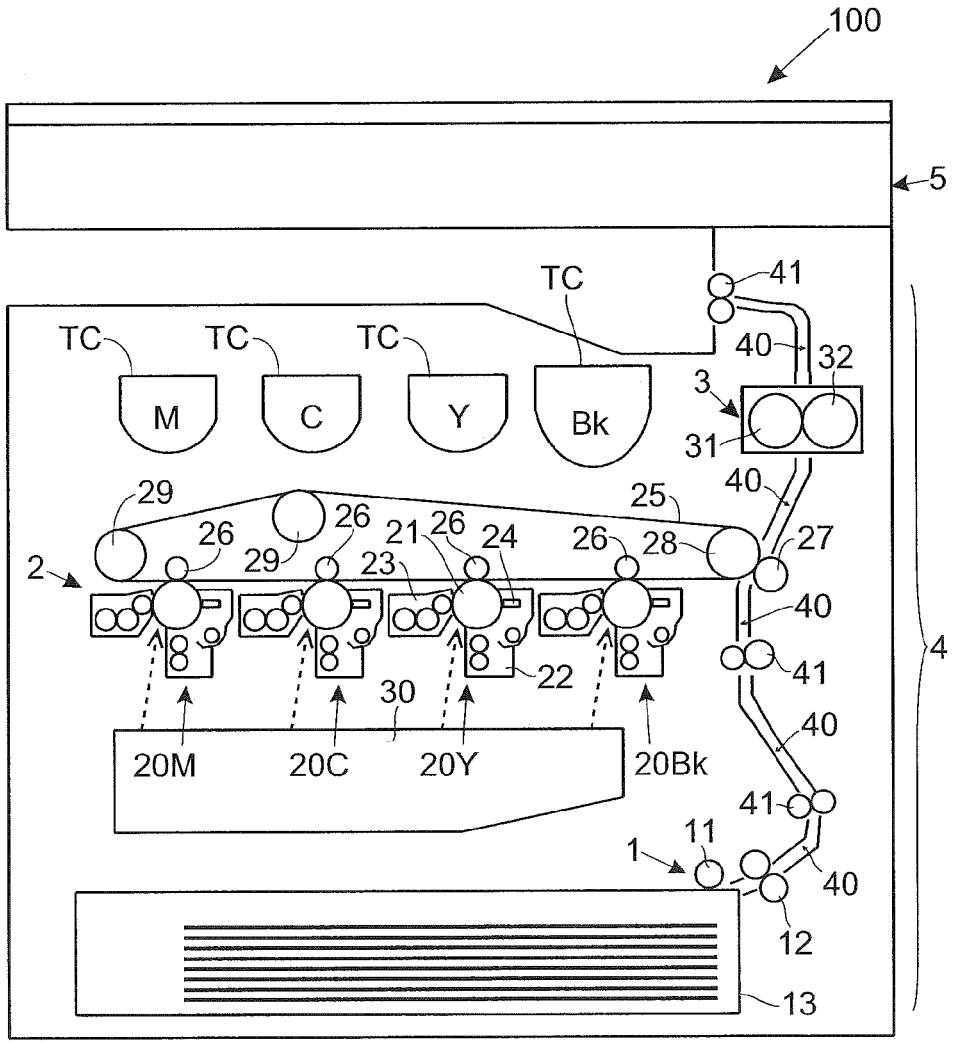
FIG. 1 is a schematic diagram of an image forming apparatus according to one embodiment of the present disclosure.

As shown in FIG. 1, an image forming apparatus 100 of this embodiment is provided with a printing portion 4 that includes a paper feed portion 1, an image forming portion 2, and a fixing portion 3. The printing portion 4 includes a paper sheet conveyance path 40 on which a plurality of conveyance roller pairs 41 are provided, conveys a paper sheet along the paper sheet conveyance path 40, and, based on image data of an image to be printed, forms a toner image. Further, the printing portion 4 prints (transfers) the toner image on the paper sheet being conveyed and ejects the paper sheet thus printed. That is, the printing portion 4 executes a printing job. Printing encompasses a series of operations in which a toner image formed by an electrophotographic process is transferred on a paper sheet and then is fixed thereon.

The paper feed portion 1 includes a pick-up roller 11 and a paper feed roller pair 12. Further, the paper feed portion 1 supplies a paper sheet housed in a paper sheet cassette 13 to the paper sheet conveyance path 40.

The image forming portion 2 is divided into mechanism portions 20Bk, 20Y, 20C, and 20M that correspond to colors of black (Bk), yellow (Y), cyan (C), and magenta (M), respectively. Each of the mechanism portions 20Bk, 20Y, 20C, and 20M has one each of a photosensitive drum 21, a charging device 22, a developing device 23, and a cleaner 24 and forms a toner image of one of the colors corresponding thereto. Furthermore, the image forming portion 2 includes an exposure device 30 for forming an electrostatic latent image on a surface of the photosensitive drum 21. The above-described image forming portion 2 adopts a configuration capable of forming color images of the four colors of black, yellow, cyan, and magenta. A configuration, however, may be adopted that is provided with one of the mechanism portions 20Bk, 20Y, 20C, and 20M, thus being capable of forming a single color image.

The developing device 23 houses developing toner, and the toner inside the developing device 23 is consumed at the time of formation of a toner image and thus is to be decreased in quantity. For this reason, toner containers TC that house replenishing toner are mounted in the image forming apparatus 100.

The image forming portion 2 further includes an intermediate transfer belt 25, a primary transfer roller 26, and a secondary transfer roller 27. The intermediate transfer belt 25 is laid under tension over a driving roller 28 and a driven roller 29. On a surface of the intermediate transfer belt 25, toner images of the respective colors (toner images formed on the surface of each of the photosensitive drums 21) are primarily transferred. Then, the toner images transferred on the surface of the intermediate transfer belt 25 are secondarily transferred on a paper sheet.

The fixing portion 3 includes a heating roller 31 and a pressing roller 32. The heating roller 31 has a built-in heat generation source. The pressing roller 32 is in pressure contact with the heating roller 31. Further, when a paper sheet enters between the heating roller 31 and the pressing roller 32, the fixing portion 3 heats and presses the paper sheet (fixes a toner image on the paper sheet).

The image forming apparatus 100 is provided also with an image reading portion 5. The image reading portion 5 reads an original document and generates image data of the original document thus read. For example, based on the image data of the original document generated at the image reading portion 5, the printing portion 4 executes a printing job.

Here, at the time of formation of a toner image by the printing portion 4, waste toner (toner to be discarded) is generated. For example, when forming a toner image (when supplying toner from the developing device 23 to the photosensitive drum 21), concurrently therewith, the printing portion 4 also performs, by using the cleaner 24, cleaning of the surface of the photosensitive drum 21. Although there is no particular limitation, the cleaner 24 is a resinous blade or brush and comes in contact with the surface of the photosensitive drum 21 to scrape off toner remaining on the surface of the photosensitive drum 21. In this manner, a part of the toner supplied from the developing device 23 to the photosensitive drum 21 that remains on the surface of the photosensitive drum 21 without being transferred on a paper sheet is removed. Further, the part of the toner removed by the cleaner 24 refers to waste toner.

Figure 2:
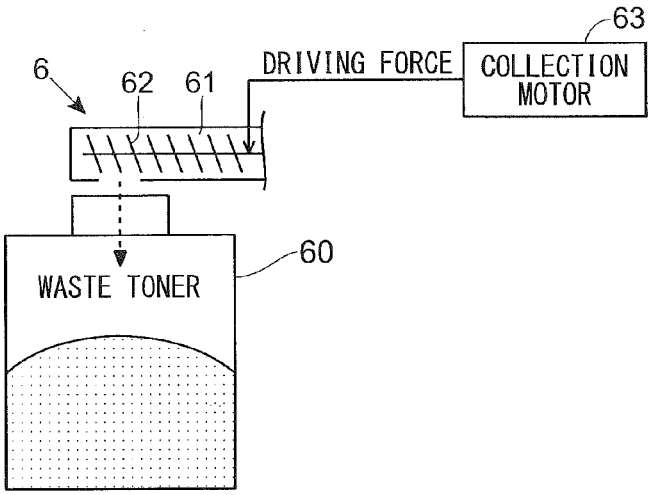
FIG. 2 is a diagram showing a configuration of a waste toner collection portion of the image forming apparatus according to the one embodiment of the present disclosure.

In order to collect waste toner generated at the time of formation of a toner image, the image forming apparatus 100 is provided with a waste toner collection portion 6 (see FIG. 2). As shown in FIG. 2, the waste toner collection portion 6 includes a waste toner conveyance path 61, a collection screw 62 that is provided on the waste toner conveyance path 61, a collection motor 63 (for example, a stepping motor) for causing the collection screw 62 to rotate by transmitting a driving force thereto, and so on. The collection screw 62 corresponds to a "conveyance member", and the collection motor 63 corresponds to a "motor".

The waste toner collection portion 6 receives waste toner removed by the cleaner 24 and conveys, by causing the collection screw 62 to rotate, the waste toner along the waste toner conveyance path 61. The waste toner conveyance path 61 is linked to a mounting space of a waste toner container 60. The waste toner conveyed along the waste toner conveyance path 61, therefore, reaches the mounting space of the waste toner container 60. When the waste toner reaches the mounting space of the waste toner container 60, the waste toner drops from the waste toner conveyance path 61, and in this manner, waste toner is accumulated in the waste toner container 60.

Although not shown, a configuration also may be adopted in which a cleaner for cleaning the surface of the intermediate transfer belt 25 is provided, and toner (toner to be discarded) remaining on the surface of the intermediate transfer belt 25 is removed through cleaning by the cleaner. In this case, the toner removed from the surface of the intermediate transfer belt 25 also is collected as waste toner in the waste toner container 60 (conveyed by the waste toner collection portion 6).

At the time of formation of a toner image by the printing portion 4, toner scatters inside the image forming apparatus 100. When toner has scattered inside the apparatus, there occurs an inconvenience such as contamination inside the apparatus (for example, the toner adheres to a pre-printed paper sheet, causing smudges on the paper sheet). To prevent this, in the image forming apparatus 100, a fan 7 (see FIG. 3) for collecting scattering toner that scatters inside the apparatus is installed. Scattering toner collected by the fan 7 is discarded. That is, scattering toner also is waste toner.

Figure 3:
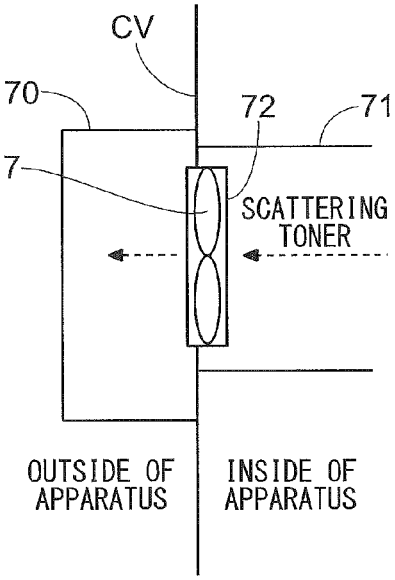
FIG. 3 is a diagram showing a configuration of a fan installed in the image forming apparatus according to the one embodiment of the present disclosure.

For example, as shown in FIG. 3, the fan 7 is installed on a back cover CV of the image forming apparatus 100. Furthermore, inside the apparatus, a suction duct 71 that extends from a position in a vicinity of the image forming portion 2 to an installation position of the fan 7 is provided. Further, the fan 7 sucks in scattering toner that scatters in the vicinity of the image forming portion 2 and discharges the scattering toner from inside the apparatus to outside the apparatus via a filter 72. Then, the scattering toner discharged to outside the apparatus is accumulated in a collection box 70 that is installed on an outer side of the back cover CV.

<Hardware Configuration of Image Forming Apparatus>

Figure 4:
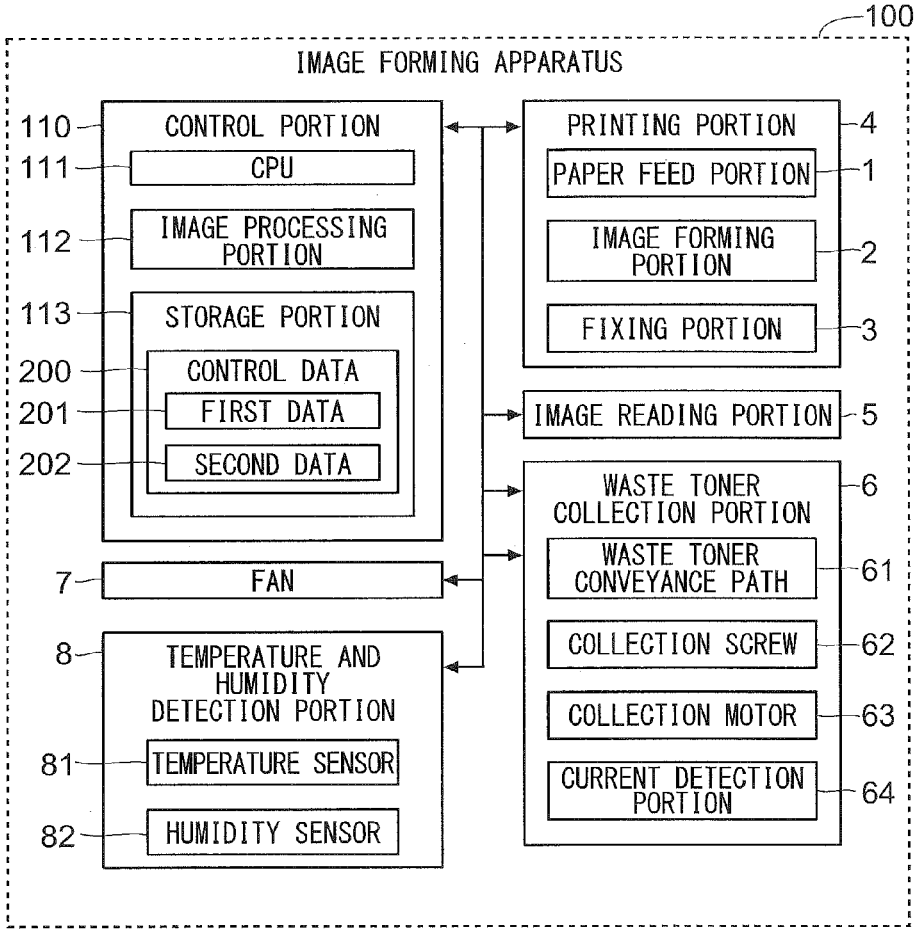
FIG. 4 is a diagram showing a hardware configuration of the image forming apparatus according to the one embodiment of the present disclosure.

As shown in FIG. 4, the image forming apparatus 100 is provided with a control portion 110. The control portion 110 includes a CPU 111, an image processing portion 112, and a storage portion 113. The image processing portion 112 is formed of an ASIC or the like and performs, with respect to image data, various types of image processing (enlargement/reduction, density conversion, data format conversion, and so on). The storage portion 113 is formed of, for example, a ROM and a RAM and stores control programs and data. Further, based on the control programs and data stored in the storage portion 113, the control portion 110 controls a printing operation of the printing portion 4 (the paper feed portion 1, the image forming portion 2, and the fixing portion 3) and a reading operation of the image reading portion 5.

Furthermore, the collection motor 63 is connected to the control portion 110. The control portion 110 controls driving of the collection motor 63, thereby to perform switching between rotation of the collection screw 62 and a stop of the rotation thereof. That is, the control portion 110 controls a collection operation of the waste toner collection portion 6. A minimum value of a driving current (minimum driving current value) for the collection motor 63 is predetermined.

When the printing portion 4 is forming a toner image (when toner is being supplied from the developing device 23 to the photosensitive drum 21), the control portion 110 controls the waste toner collection portion 6 to collect waste toner. For example, when starting a printing job by the printing portion 4 (when starting formation of a toner image), the control portion 110 controls the collection screw 62 to rotate (starts collection of waste toner by the waste toner collection portion 6). In a printing job, upon a start of supplying (feeding) a paper sheet to the paper sheet conveyance path 40, formation of a toner image (including formation of an electrostatic latent image) is started.

Then, upon completion of the printing job, the control portion 110 controls the collection screw 62 to stop from rotating (completes collection of waste toner by the waste toner collection portion 6). Alternatively, a configuration may be adopted in which at timing after a lapse of a given length of time from completion of a printing job, the collection screw 62 is stopped from rotating.

Not only at the time of executing a printing job, but also at the time of executing a calibration process, a toner forcible discharge process, or the like, a toner image is formed by the printing portion 4. Further, also at this time, the control portion 110 controls the waste toner collection portion 6 to collect waste toner. For example, in a calibration process, in order to correct a density or a color deviation of an outputted image, a toner image for calibration is formed. In a toner forcible discharge process, in order to replace toner inside the developing device 23 with fresh toner (reduce deteriorated toner), a solid toner image is formed.

Here, a current detection portion 64 for detecting a magnitude of an electric current flowing through the collection motor 63 (hereinafter, referred to as a motor current value) is connected to the collection motor 63. For example, the current detection portion 64 includes a current detection resistance that is connected to the collection motor 63. An output of the current detection portion 64 is received by the control portion 110. Then, based on the output of the current detection portion 64, the control portion 110 detects the motor current value of the collection motor 63. The motor current value detected by the control portion 110 based on the output of the current detection portion 64 is used for driving control of the fan 7. A detail thereof will be described later.

The fan 7 having a fan motor also is connected to the control portion 110. The control portion 110 controls driving (rotation and a stop of the rotation) of the fan 7. For example, when having started collection of waste toner by the waste toner collection portion 6 (when the collection motor 63 has been brought to a constant speed state), the control portion 110 sets a value of rotation speed (a rotation speed) of the fan 7 and starts driving of the fan 7 at said set value of the rotation speed. At this time, based on the motor current value of the collection motor 63, the control portion 110 sets the value of the rotation speed of the fan 7. A detail thereof will be described later.

A minimum value of the rotation speed (minimum rotation speed) of the fan 7 is predetermined. For example, when the motor current value of the collection motor 63 is equal to the minimum driving current value, the rotation speed of the fan 7 is set to the minimum rotation speed.

A temperature and humidity detection portion 8 also is connected to the control portion 110. The temperature and humidity detection portion 8 includes a temperature sensor 81 and a humidity sensor 82. The temperature sensor 81 and the humidity sensor 82 correspond to a "temperature detection portion" and a "humidity detection portion", respectively.

The temperature and humidity detection portion 8 is installed on an exterior cover (not shown) of the image forming apparatus 100. For example, in order to avoid an influence of heat generation by the fixing portion 3, an installation position of the temperature and humidity detection portion 8 is set to be away from the fixing portion 3. Further, based on an output of the temperature and humidity detection portion 8, the control portion 110 detects temperature and humidity (relative humidity) at a periphery of the image forming apparatus 100. The temperature and humidity detected by the control portion 110 based on the output of the temperature and humidity detection portion 8 is used for driving control of the fan 7. A detail thereof will be described later. The temperature and humidity detection portion 8 may be installed in a vicinity of the image forming portion 2 (inside the apparatus). That is, a configuration may be adopted in which based on temperature and humidity inside the apparatus, driving control of the fan 7 is performed.

<Driving Control of Fan>

A quantity of waste toner generated varies depending on a toner image formation condition (job execution condition). For example, in a job performed using a high number of printing dots per page, compared with a job performed using a low number of printing dots per page, a quantity of toner supplied from the developing device 23 to the photosensitive drum 21 (toner consumed) is increased, and thus a quantity of toner removed by the cleaner 24 is increased accordingly, as a result of which a quantity of waste toner also is increased. With the quantity of waste toner increased, a quantity of waste toner collected by the waste toner collection portion 6 (waste toner conveyed by the collection screw 62) is increased.

Moreover, in the job performed using a high number of printing dots per page, compared with the job performed using a low number of printing dots per page, a quantity of scattering toner inside the apparatus (toner to be sucked in and discharged by the fan 7) also is increased. That is, when a quantity of waste toner collected by the waste toner collection portion 6 is large, it follows that a quantity of scattering toner inside the apparatus is large.

With the quantity of scattering toner inside the apparatus increased, an inconvenience of causing contamination inside the apparatus becomes likely to occur. Hence, in a case where a quantity of scattering toner inside the apparatus is large, preferably, the scattering toner is collected immediately. For this reason, in driving the fan 7, the control portion 110 judges whether a quantity of scattering toner inside the apparatus is large or small and sets a value of the rotation speed of the fan 7 so that the larger the quantity of scattering toner, the higher the rotation speed of the fan 7 (drives the fan 7 at said set value of the rotation speed).

Whether a quantity of scattering toner inside the apparatus is large or small can be judged based on the motor current value of the collection motor 63. For example, in a case where a quantity of waste toner collected by the waste toner collection portion 6 is large (that is, in a case where a quantity of scattering toner inside the apparatus is large), a load of the collection motor 63 becomes large, so that the motor current value is increased.

With this as a basis, in driving the fan 7, based on an output of the current detection portion 64, the control portion 110 detects a value of the motor current value. When the value of the motor current value detected based on the output of the current detection portion 64 is large, it can be said that a quantity of scattering toner inside the apparatus is large. Then, the control portion 110 sets the rotation speed of the fan 7 so that the larger the motor current value, the higher the rotation speed. Thus, the larger a quantity of scattering toner inside the apparatus, the higher the rotation speed of the fan 7 becomes.

Figure 5:
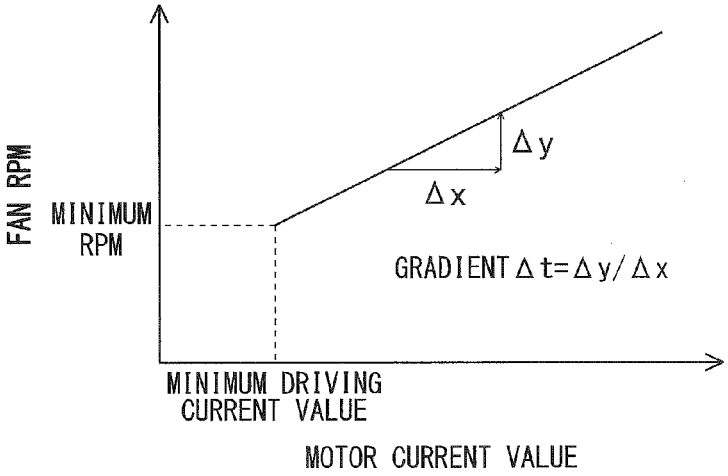
FIG. 5 is a diagram for explaining setting of rotation speed of the fan performed in the image forming apparatus according to the one embodiment of the present disclosure.

For example, as shown in FIG. 5, a gradient (ratio) of a variation (an amount of increase) in rotation speed of the fan 7 with respect to a variation (an amount of increase) in motor current value of the collection motor 63 is predetermined (gradient $\Delta t = \Delta y / \Delta x$). Further, based on the predetermined gradient, the control portion 110 determines a value of the rotation speed of the fan 7 corresponding to the value of the motor current value detected based on the output of the current detection portion 64, and sets said determined value as the rotation speed of the fan 7.

By the way, under a high humidity environment, a water absorption quantity of toner is increased, and under a low humidity environment, the water absorption quantity of toner becomes less than that in the high humidity environment. With the water absorption quantity of toner increased, the toner becomes less likely to scatter, and thus a quantity of scattering toner is decreased. Hence, even when the same toner image formation condition (number of printing dots per page or the like) is used, there occurs a difference in quantity of scattering toner generated between a case where a toner image is formed under a high humidity environment and a case where a toner image is formed under a low humidity environment. That is, in the case where a toner image is formed under a high humidity environment, compared with the case where a toner image is formed under a low humidity environment, a quantity of scattering toner inside the apparatus is decreased.

Hence, in driving the fan 7, based on an output of the current detection portion 64, the control portion 110 detects the motor current value, and moreover, based on an output of the temperature and humidity detection portion 8, the control portion 110 also detects temperature and humidity at a periphery of the image forming apparatus 100 or inside the apparatus (hereinafter, referred to simply as temperature and humidity). Then, based on the motor current value and the temperature and humidity, the control portion 110 sets the rotation speed of the fan 7.

Control data 200 for selling the rotation speed of the fan 7 based on the motor current value and temperature and humidity in this manner is predetermined and stored in the storage portion 113 (see FIG. 4). The control data 200 includes first data 201 and second data 202.

Figures 6, 7:
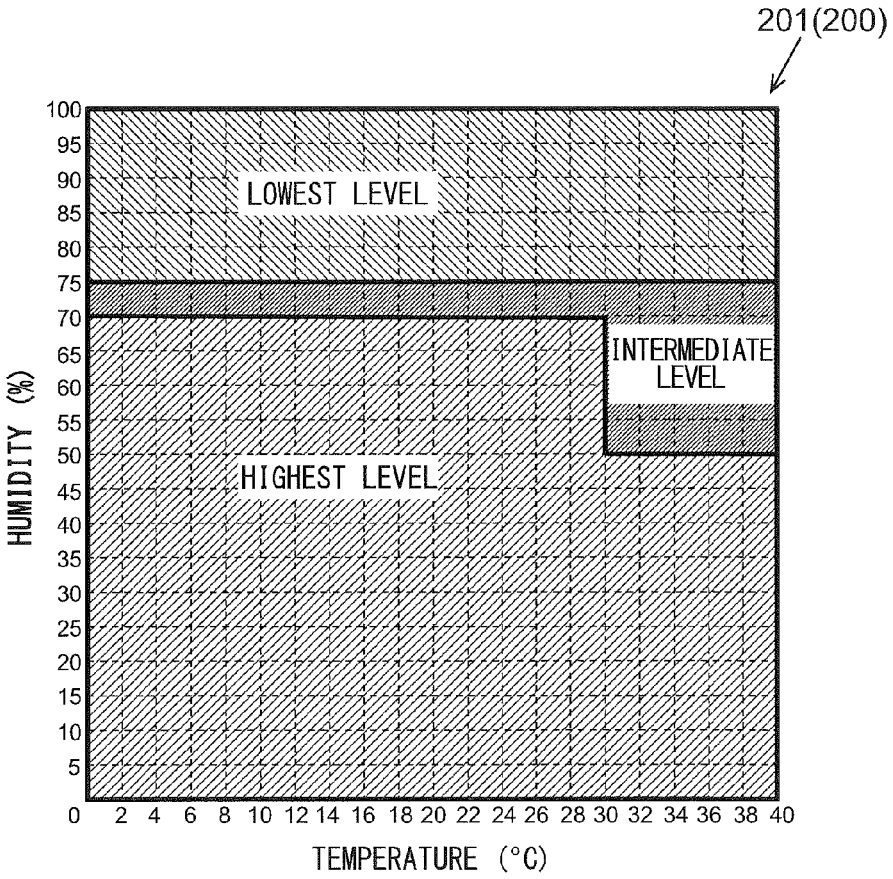
FIG. 6 is a diagram for explaining control data (first data) used for the setting of rotation speed of the fan performed in the image forming apparatus according to the one embodiment of the present disclosure.
FIG. 7 is a diagram for explaining control data (second data) used for the setting of rotation speed of the fan performed in the image forming apparatus according to the one embodiment of the present disclosure.

As shown in FIG. 6, the first data 201 is data obtained by categorizing levels of a scattering degree, which indicates a likelihood of generation of scattering toner that varies depending on temperature and humidity, into a plurality of scattering levels and predetermining values of temperature and humidity corresponding to the plurality of scattering levels, respectively. In FIG. 6, the levels of the scattering degree are identified by different types of hatching.

Although there is no particular limitation, the levels of the scattering degree are categorized into three stages. That is, the levels of the scattering degree are categorized into three stages of a highest level (a level at which scattering toner is most likely to be generated), a lowest level (a level at which scattering toner is least likely to be generated), and an intermediate level between the highest level and the lowest level. While, here, a description is given of an example in which the levels of the scattering degree are categorized into three stages, the levels of the scattering degree may be categorized into two stages or four or more stages.

For example, in a case of a temperature of lower than 30° C., the highest level is achieved at a humidity range of not lower than 0% and lower than 70%, the intermediate level is achieved at a humidity range of not lower than 70% and lower than 75%, and the lowest level is achieved at a humidity range of not lower than 75%. Furthermore, in a case of a temperature of not lower than 30° C., the highest level is achieved at a humidity range of not lower than 0% and lower than 50%, the intermediate level is achieved at a humidity range of not lower than 50% and lower than 75%, and the lowest level is achieved at a humidity range of not lower than 75%.

As shown in FIG. 7, the second data 202 is data obtained by predetermining values of the gradient (the gradient of a variation in rotation speed of the fan 7 with respect to a variation in motor current value of the collection motor 63) corresponding to the plurality of scattering levels, respectively. Here, the values of the gradient corresponding to the plurality of scattering levels, respectively, are set to be larger as the scattering degree becomes higher in level. That is, the value of the gradient corresponding to the highest level is set to be largest (see FIG. 8A). The value of the gradient corresponding to the intermediate level is set to have a magnitude between the value of the gradient corresponding to the highest level and the value of the gradient corresponding to the lowest level (see FIG. 8B). The value of the gradient corresponding to the lowest level is set to be smallest (see FIG. 8C).

For example, the value of the gradient corresponding to the highest level is set to "1", the value of the gradient corresponding to the intermediate level is set to "0.5", and the value of the gradient corresponding to the lowest level is set to "0". Magnitudes of the gradient corresponding to the plurality of scattering levels, respectively, can be changed.

Further, in driving the fan 7, based on an output of the temperature and humidity detection portion 8, the control portion 110 detects present values of temperature and humidity. Subsequently, based on the first data 201, the control portion 110 determines a level of the scattering degree corresponding to the present values of temperature and humidity. Upon determining the level of the scattering degree corresponding to the present values of temperature and humidity, the control portion 110 recognizes said determined level of the scattering degree as a subject level (a present level of the scattering degree). For example, in a case of using the first data 201 shown in FIG. 6, when a present value of temperature is 20° C. and a present value of humidity is 50%, the subject level is the highest level, and when a present value of temperature is 20° C. and a present value of humidity is 90%, the subject level is the lowest level.

Furthermore, based on the second data 202, the control portion 110 determines a value of the gradient (the gradient of a variation in rotation speed of the fan 7 with respect to a variation in motor current value of the collection motor 63) corresponding to the subject level. For example, in a case of using the second data 202 shown in FIG. 7, when the subject level is the highest level, the value of the gradient is "1", and when the subject level is the lowest level, the value of the gradient is "0". That is, the higher a level of the scattering degree (the more likely toner is to scatter), the larger a value of the gradient determined by the control portion 110.

After that, based on the value of the gradient corresponding to the subject level, the control portion 110 determines a value of the rotation speed of the fan 7 corresponding to a value of the motor current value (this can be determined based on, for example, a linear function expression $y=ax+b$). Then, the control portion 110 sets said determined value as the rotation speed of the fan 7.

Figure 8A:
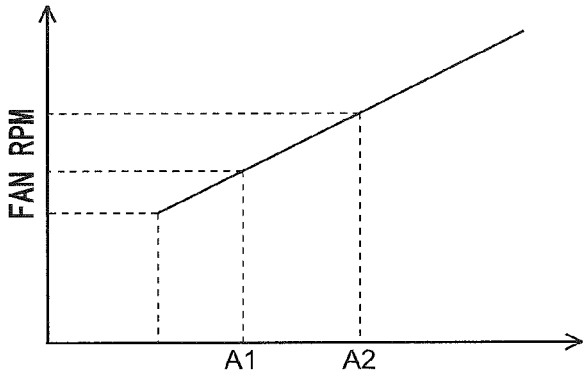
FIG. 8A is a diagram for explaining the setting of rotation speed of the fan performed in the image forming apparatus according to the one embodiment of the present disclosure (a diagram in a case where a scattering level is highest).
Figure 8B:
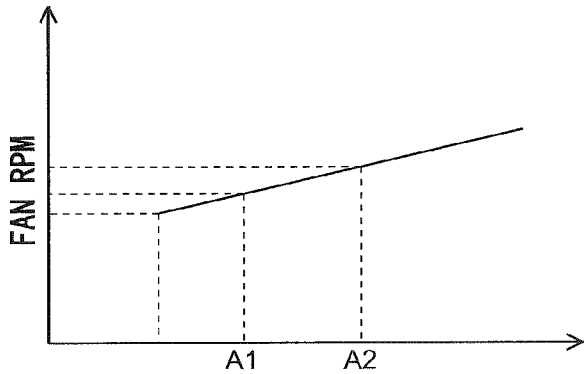
FIG. 8B is a diagram for explaining the setting of rotation speed of the fan performed in the image forming apparatus according to the one embodiment of the present disclosure (a diagram in a case where the scattering level is intermediate).
Figure 8C:
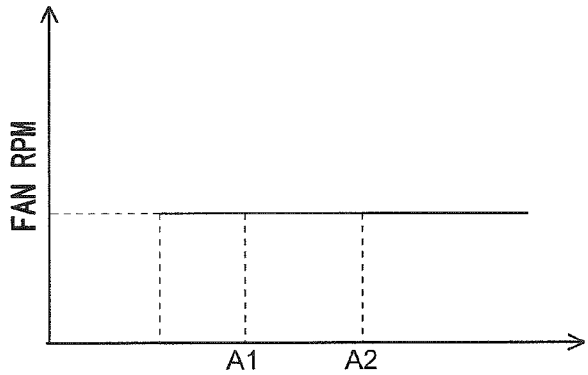
FIG. 8C is a diagram for explaining the setting of rotation speed of the fan performed in the image forming apparatus according to the one embodiment of the present disclosure (a diagram in a case where the scattering level is lowest).

As a result, as shown in FIG. 8A to FIG. 8C, a comparison between a case where the motor current value has a small value (denoted as a current value A1) and a case where the motor current value has a large value (denoted as a current value A2) indicates that the rotation speed of the fan 7 is larger in the case where the motor current value has a large value. In a case, however, where the subject level is the lowest level (a case where the gradient is 0), regardless of a magnitude of the motor current value, the same value is set as the rotation speed of the fan 7. For example, when the subject level is the lowest level, the rotation speed of the fan 7 is fixed to the predetermined minimum rotation speed.

Furthermore, a comparison between a case of having a high level of the scattering degree and a case of having a low level of the scattering degree indicates that, even when the same value is used as the motor current value, the rotation speed of the fan 7 is larger in the case of having a high level of the scattering degree. That is, the control portion 110 performs setting so that the larger a value of the motor current value detected based on an output of the current detection portion 64 and the higher a level of the scattering degree determined based on an output value of the temperature and humidity detection portion 8 (the lower the humidity), the larger a value set as the rotation speed of the fan 7 (the higher the rotation speed of the fan 7).

Here, when a lapse of time from a start of driving the fan 7 has reached a prescribed length of time (a dozen or so seconds to several tens of seconds), the control portion 110 detects, based on an output of the current detection portion 64, a value of the motor current value and also detects, based on an output of the temperature and humidity detection portion 8, values of temperature and humidity, upon which, based on the value of the motor current value and values of temperature and humidity at that point in time, the control portion 110 resets the rotation speed of the fan 7. Then, the control portion 110 performs control so that the fan 7 is driven at a reset value of the rotation speed (switches the rotation speed of the fan 7). In a case, however, where a job has been completed (a case where the fan 7 has been stopped from being driven) before the lapse of time from a start of driving the fan 7 reaches the prescribed length of time, resetting of the rotation speed of the fan 7 (switching of the rotation speed of the fan 7) is not performed. A configuration also may be adopted in which after the rotation speed of the fan 7 has been reset, every time a lapse of time from resetting performed last time reaches a prescribed length of time, resetting of the rotation speed of the fan 7 is performed.

Alternatively, when the number of paper sheets printed from a start of driving the fan 7 has reached a prescribed number (a dozen or so paper sheets to several tens of paper sheets), the control portion 110 detects, based on an output of the current detection portion 64, a value of the motor current value and also detects, based on an output of the temperature and humidity detection portion 8, values of temperature and humidity, upon which based on the value of the motor current value and values of temperature and humidity at that point in time, the control portion 110 resets the rotation speed of the fan 7. Then, the control portion 110 performs control so that the fan 7 is driven at a reset value of the rotation speed. In a case, however, where a job has been completed (a case where the fan 7 has been stopped from being driven) before the number of paper sheets printed from a start of driving the fan 7 reaches the prescribed number, resetting of the rotation speed of the fan 7 (switching of the rotation speed of the fan 7) is not performed. A configuration also may be adopted in which after the rotation speed of the fan 7 has been reset, every time the number of paper sheets printed from resetting performed last time reaches a prescribed number, resetting of the rotation speed of the fan 7 is performed.

Figure 9:
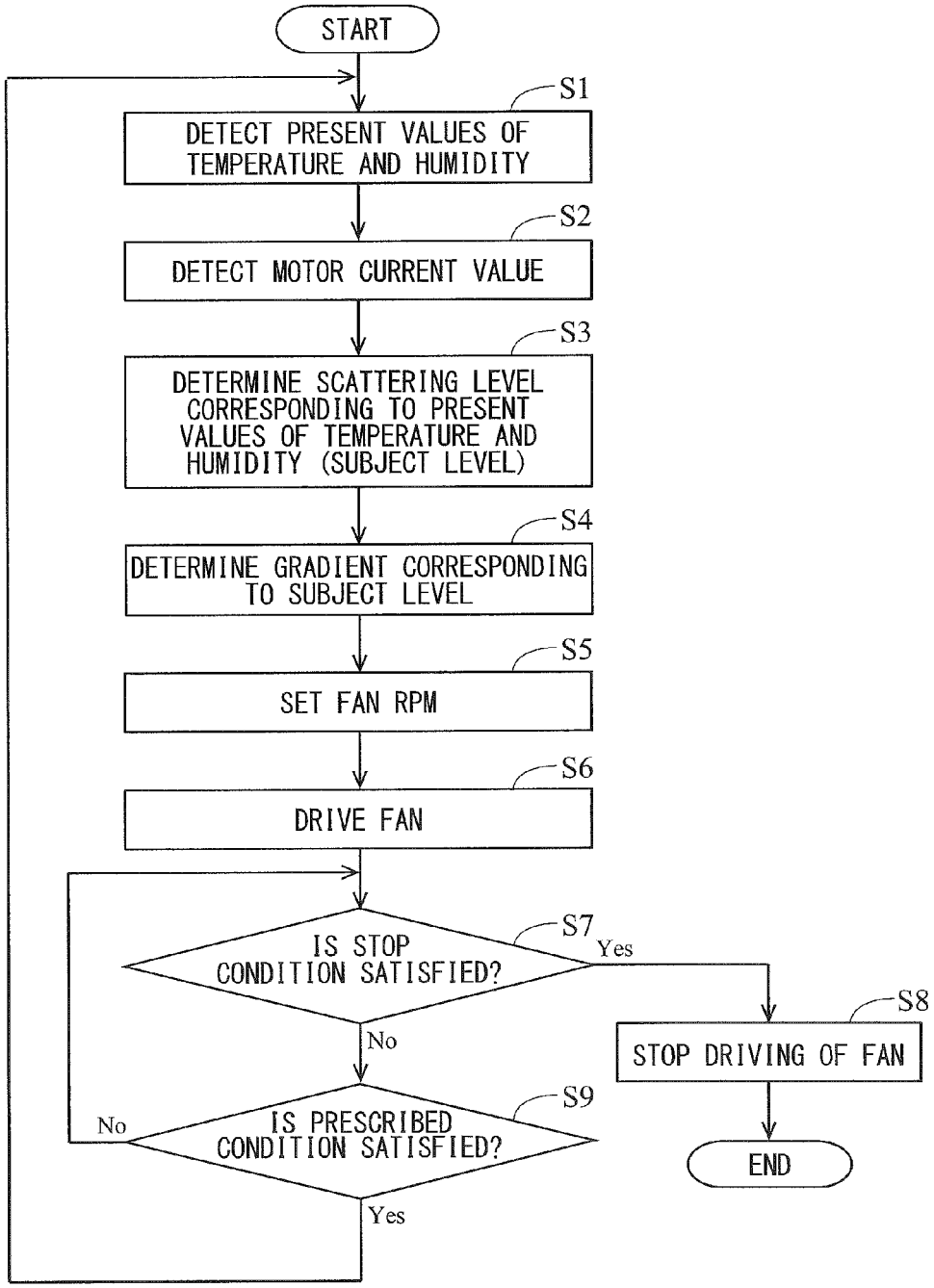
FIG. 9 is a flow chart for explaining a flow of a setting process of setting the rotation speed of the fan performed in the image forming apparatus according to the one embodiment of the present disclosure.

With reference to a flow chart shown in FIG. 9, the following describes a flow of driving control of the fan 7. The flow chart shown in FIG. 9 starts when collection of waste toner by the waste toner collection portion 6 is started.

At Step S1, based on an output of the temperature and humidity detection portion 8, the control portion 110 detects present values of temperature and humidity. Furthermore, at Step S2, based on an output of the current detection portion 64, the control portion 110 detects a value of the motor current value of the collection motor 63. Step S1 and Step S2 may be reversed in order.

At Step S3, the control portion 110 determines that one of the plurality of scattering levels which corresponds to the present values of temperature and humidity. That is, the control portion 110 determines a subject level. Furthermore, at Step S4, the control portion 110 determines a value of the gradient (the gradient of a variation in rotation speed of the fan 7 with respect to a variation in motor current value of the collection motor 63) corresponding to the subject level. After that, at Step S5, based on the value of the gradient corresponding to the subject level, the control portion 110 determines a value of the rotation speed of the fan 7 corresponding to the value of the motor current value (the current value detected at Step S2) and sets said determined value as the rotation speed of the fan 7. Then, at Step S6, the control portion 110 performs control so that the fan 7 is driven at the value of the rotation speed set based on the value of the gradient corresponding to the subject level.

At Step S7, the control portion 110 judges whether or not a stop condition is satisfied. When a job presently being executed (formation of a toner image) is completed, the control portion 110 judges that the stop condition is satisfied. Alternatively, after a lapse of a given length of time from completion of a job presently being executed, the control portion 110 judges that the stop condition is satisfied. Further, in a case where the control portion 110 judges that the stop condition is satisfied, a transition is made to Step S8. Upon the transition to Step S8, the control portion 110 performs control so that the fan 7 is stopped from being driven.

In a case where, at Step S7, the control portion 110 judges that the stop condition is not satisfied, a transition is made to Step S9. Upon the transition to Step S9, the control portion 110 judges whether or not a prescribed condition is satisfied. When a lapse of time from a start of driving the fan 7 (a lapse of time from setting of the rotation speed of the fan 7 performed last time) has reached a prescribed length of time, the control portion 110 judges that the prescribed condition is satisfied. Alternatively, when the number of paper sheets printed from a start of driving the fan 7 (the number of paper sheets printed from setting of the rotation speed of the fan 7 performed last time) has reached a prescribed number, the control portion 110 judges that the prescribed condition is satisfied.

In a case where, at Step S9, the control portion 110 judges that the prescribed condition is satisfied, a transition is made to Step S1 (resetting of the rotation speed of the fan 7 is performed). On the other hand, in a case where, at Step S9, the control portion 110 judges that the prescribed condition is not satisfied, a transition is made to Step S7 (it is judged whether or not the stop condition is satisfied).

As described above, in the image forming apparatus 100 of this embodiment, the control portion 110 sets the rotation speed of the fan 7 so that the larger the motor current value, the higher the rotation speed. Here, when a quantity of waste toner including scattering toner is increased and thus a quantity of waste toner to be collected at the waste toner collection portion 6 (a quantity of waste toner to be conveyed by the collection screw 62) is increased, a load of the collection motor 63 becomes large, so that the motor current value is increased. That is, in this configuration, when a quantity of scattering toner is large, the rotation speed of the fan 7 is set to be higher, and thus collection capability (capability of sucking in and discharging scattering toner) of the fan 7 is enhanced. This can suppress occurrence of an inconvenience in which, in a case where a quantity of scattering toner is large, the scattering toner cannot be collected completely, causing contamination inside the apparatus.

The rotation speed of the fan 7 is set so that the larger the motor current value, the higher the rotation speed, and it follows that the rotation speed of the fan 7 is set so that the smaller the motor current value, the lower the rotation speed. That is, in a case where a quantity of scattering toner is small, the rotation speed of the fan 7 becomes low. This can suppress power consumption of the fan 7. When the rotation speed of the fan 7 becomes low, however, the collection capability of the fan 7 is degraded. Even so, it is when a quantity of scattering toner is small that the rotation speed of the fan 7 becomes low. Hence, even when the rotation speed of the fan 7 becomes low and thus the collection capability of the fan 7 is degraded, scattering toner inside the apparatus can be collected to a sufficient degree.

Furthermore, in this embodiment, in driving the fan 7, based on an output of the temperature and humidity detection portion 8, the control portion 110 detects present values of temperature and humidity and determines that one of the plurality of scattering levels (the highest level, the intermediate level, and the lowest level) which corresponds to the present values of temperature and humidity as a subject level. Then, based on a value of the gradient corresponding to the subject level, the control portion 110 determines a value of the rotation speed of the fan 7 corresponding to a value of the motor current value detected based on an output of the current detection portion 64 and sets said determined value as the rotation speed of the fan 7. According to this configuration, a comparison between a case of having a high level of the scattering degree and a case of having a low level of the scattering degree indicates that, even when the same value is used as the motor current value, the rotation speed of the fan 7 is larger in the case of having a high level of the scattering degree. Thus, even when an installation environment (temperature and humidity) of the image forming apparatus 100 changes to bring about a state where scattering toner is likely to be generated, it is possible to suppress occurrence of an inconvenience in which scattering toner cannot be collected completely, causing contamination inside the apparatus. Furthermore, in the case of having a low level of the scattering degree, the rotation speed of the fan 7 becomes lower than that in the case of having a high level of the scattering degree, and thus power consumption of the fan 7 can be further suppressed.

Furthermore, in this embodiment, a value of the gradient corresponding to one of the plurality of scattering levels having the lowest level of the scattering degree (lowest level) is set to 0. That is, when a level of the scattering degree is lowest, regardless of the motor current value, the rotation speed of the fan 7 is set to the minimum rotation speed. According to this configuration, power consumption of the fan 7 can be further suppressed.

Furthermore, in this embodiment, when a lapse of time from a start of driving the fan 7 has reached a prescribed length of time, the control portion 110 resets the rotation speed of the fan 7 to a reset value and performs control so that the fan 7 is driven at said reset value of the rotation speed. Alternatively, when the number of paper sheets printed from a start of driving the fan 7 has reached a prescribed number, the control portion 110 resets the rotation speed of the fan 7 to a reset value and performs control so that the fan 7 is driven at said reset value of the rotation speed. According to this configuration, after driving of the fan 7 has been started, when a quantity of scattering toner is decreased, the rotation speed of the fan 7 can be set to be lower, and when a quantity of scattering toner is increased, the rotation speed of the fan 7 can be set to be higher.

The embodiment disclosed herein is to be construed in all respects as illustrative and not limiting. The scope of the present disclosure is indicated by the appended claims rather than by the foregoing description of the embodiment, and all changes that come within the meaning and range of equivalency of the claims are intended to be embraced therein.

What is claimed is:

1. An image forming apparatus, comprising:

a printing portion that forms a toner image and prints the toner image on a paper sheet;

a waste toner collection portion that includes a motor and a conveyance member that is driven by the motor, and conveys, by using the conveyance member, waste toner generated at a time of formation of the toner image by the printing portion, thereby to collect the waste toner in a waste toner container;

a current detection portion for detecting a motor current value that is a value of an electric current flowing through the motor;

a fan that sucks in scattering toner that scatters inside the image forming apparatus and discharges the scattering toner to outside the apparatus; and a control portion that controls driving of the fan, wherein in driving the fan, based on an output of the current detection portion, the control portion detects a value of the motor current value, and sets rotation speed of the fan so that the larger said detected value of the motor current value, the higher the rotation speed of the fan.

2. The image forming apparatus according to claim 1, further comprising:

a temperature detection portion for detecting temperature at a periphery of the image forming apparatus or inside the apparatus;

a humidity detection portion for detecting humidity at the periphery of the image forming apparatus or inside the apparatus; and a storage portion that stores control data that is data for setting the rotation speed of the fan based on the motor current value, the control data being data obtained by categorizing levels of a scattering degree, which indicates a likelihood of generation of the scattering toner that varies depending on the temperature and humidity at the periphery of the image forming apparatus or inside the apparatus, into a plurality of scattering levels and predetermining values of the temperature and humidity at the periphery of the image forming apparatus or inside the apparatus corresponding to the plurality of scattering levels, respectively, and data obtained by predetermining values of a gradient of a variation in the rotation speed of the fan with respect to a variation in the motor current value corresponding to the plurality of scattering levels, respectively, which are set to be larger as the scattering degree becomes higher in level, wherein in driving the fan, based on respective outputs of the temperature detection portion and the humidity detection portion, the control portion detects present values of the temperature and humidity, determines that one of the plurality of scattering levels which corresponds to the present values of the temperature and humidity as a subject level, based on one of the values of the gradient corresponding to the subject level, determines a value of the rotation speed of the fan corresponding to the value of the motor current value detected based on the output of the current detection portion, and sets said determined value as the rotation speed of the fan.

3. The image forming apparatus according to claim 2, wherein one of the values of the gradient corresponding to one of the plurality of scattering levels having a lowest level of the scattering degree is 0.

4. The image forming apparatus according to claim 1, wherein when a lapse of time from a start of driving the fan has reached a prescribed length of time, the control portion detects, based on an output of the current detection portion, a value of the motor current value and resets, based on said detected value of the motor current value, the rotation speed of the fan to a reset value, and then the control portion performs control so that the fan is driven at said reset value of the rotation speed.

5. The image forming apparatus according to claim 1, wherein when a number of paper sheets printed from a start of driving the fan has reached a prescribed number, the control portion detects, based on an output of the current detection portion, a value of the motor current value and resets, based on said detected value of the motor current value, the rotation speed of the fan to a reset value, and then the control portion performs control so that the fan is driven at said reset value of the rotation speed.

* * * * *